US007163070B2

(12) United States Patent
Gienau et al.

(10) Patent No.: US 7,163,070 B2
(45) Date of Patent: Jan. 16, 2007

(54) DRILL HEAD

(75) Inventors: Roland Gienau, Westendorf (DE); Wolfgang Ludwig, Klosterlechfeld (DE); Erich Leibhard, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 123 days.

(21) Appl. No.: 10/898,881

(22) Filed: Jul. 26, 2004

(65) Prior Publication Data

US 2005/0051365 A1 Mar. 10, 2005

(30) Foreign Application Priority Data

Jul. 29, 2003 (DE) ..... 103 34 610

(51) Int. Cl.
*E21B 10/36* (2006.01)

(52) U.S. Cl. ..... 175/418; 175/213

(58) Field of Classification Search ..... 175/213, 175/396, 404, 418

See application file for complete search history.

(56) References Cited

U.S. PATENT DOCUMENTS 2,252,168 A * 8/1941 Crcighton ..... 175/317
2,256,092 A * 9/1941 Metz et al. ..... 175/405.1
3,179,190 A 4/1965 Blasi
3,215,215 A * 11/1965 Kellner ..... 175/405.1
3,951,220 A * 4/1976 Phillips et al. ..... 175/393
4,694,916 A * 9/1987 Ford ..... 175/249
4,711,609 A * 12/1987 Seefluth ..... 408/68
5,492,187 A 2/1996 Neukirchen et al.

FOREIGN PATENT DOCUMENTS

| | | |
|---|---|---|
| DE | 4411441 | 10/1991 |
| DE | G9308443.9 | 9/1993 |
| SU | 1740610 | 6/1992 |
| WO | 9611323 | 4/1996 |

* cited by examiner

*Primary Examiner*—Hoang Dang
(74) *Attorney, Agent, or Firm*—Abelman, Frayne & Schwab

(57) ABSTRACT

A drill head for use in drilling bores in mines and tunnels has a bit and at least one suction opening (5) for removing drillings and having a crushing profile.

5 Claims, 1 Drawing Sheet

DRILL HEAD

BACKGROUND OF THE INVENTION

1. Field of the Invention

The present invention relates to a drill head for drills, in particular for drills usable in mine and tunnel constructions, and having a bit, which can be inserted into the drill head or formed thereon, and at least one suction opening for removing drillings.

2. Description of the Prior Art

Drill heads of the type described above are used in dry drilling processes and are usually put on tubular drill pipes. The drill heads have usually a bit formed at the cutting side, or an insertable hard material bit receivable in a recess provided on the cutting side. On the cutting side, there is provided at least one suction opening that enables aspiration of drillings through the drill pipe.

A drill head of the type discussed above is disclosed, e.g., in U.S. Pat. No. 4,711,312 and has a hard material bit inserted in a recess formed in the cutting side and projecting therefrom beyond the cutting side of the drill head. At the cutting side, there are provided two diametrically opposite suction openings.

For insuring a high drilling advance, the bit projects beyond the cutting surface or side. However, the further the bit projects beyond the cutting side of the drill head the more coarse or bigger are the drillings which are produced during drilling of a bore. In addition, with high drilling speeds as, e.g., at dry drilling in carbonaceous materials, e.g., secondary material pieces, coarse drillings, are produced.

The drawback of the known drill head consists in that coarse drillings reach directly into the drill pipe through the suction openings, which can result in clogging of the drill pipe. Therefore, the drilling process has to be interrupted at least once so that in order to insure an adequate drilling process, the drill pipe is cleaned with a special tool to make the drill pipe passable again.

Accordingly, an object of the present invention is to provide a drill head which would provide for a high drilling speed and would prevent clogging of the drill pipe during suction of drillings to a most possible extent.

SUMMARY OF THE INVENTION

This and other objects of the present invention, which will become apparent hereinafter, are achieved by providing at least one suction opening that has a crushing profile. The crushing profile of the at least one opening prevents a direct penetration of coarse drilling into the drill pipe. Fine drillings are directly aspirated through the suction opening(s), whereas the coarse drilling are further comminuted or crushed and only then are aspirated. Further, the crushing profile reduces the surface of the cutting side of the drill head which leads to an increased drilling advance with an increased press-on pressure. With conventional drill head the press-on pressure is in a range from 10 to 25 kN. The inventive drill head with a crushing profile at the suction opening can also be used in a wet drilling process.

When the drill head has several suction openings, each of the suction openings is provided with a crushing profile. With several suction openings, only every second suction opening may be provided with a crushing profile, with the size of the suction openings without the crushing profile being so selected that the drillings, which penetrate into the drill head and, thus, into the drill pipe do not lead to clogging of the drill pipe.

Advantageously, the crushing profile is formed by toothing provided on the drill circumference. Such formation of the crushing profile insures a continuous crushing of coarse drillings until they can be aspirated through the suction openings.

Advantageously, radial distance of the tooth crowns of the toothing from the center of the drill head decreases. Such formation of the crushing profile insures comminuting of coarse drillings and prevents to a most possible extent clogging of the drill pipe in the underground even with hard drillings. Advantageously, the radial distances of the tooth crowns of the crushing profile from the drill head center decreases continuously.

Advantageously, the depressions between the tooth crowns have a cross-section of a circular segment. This insures a certain swirling of coarse drillings, providing for further crushing, which facilitate comminuting of coarse drilling.

Advantageously, the tooth roots of the toothing lie essentially on a circle having its center in the center of the bore head. The radius of this circle is advantageously so selected that remaining opening on the cutting side for removal of drillings have a cross-section which does not permit passing therethrough and into the drill pipe of coarse drillings. In addition, the arrangement of tooth roots on a circle having its center in the center of the drill head insures an adequate support of the bit which is either formed on or inserted into the cutting side of the drill head, which insures that the drill head can absorb loads acting on the cutting bit. The arrangement of the tooth roots on a circle having its center in the center of the drill head in combination with the reduction of radial distances of the tooth crown provides for continuous reduction of the receiving regions between the tooth crowns of the toothing along the toothing. This prevents, on one hand, retention of coarse drillings in the depressions of the toothing and, on the other hand, reduces a danger of jamming of the drill head in a constructional component.

Advantageously, the drill head is produced by a casting process, which insures a cost-effective manufacturing of the drill head. When the drill head is used as a part of a self-drilling, chemical connection anchor, the drill head remains in the constructional component. That is why the drill head should not be expensive. Alternatively, the drill head can be produced by being cast in a form, with a final shape obtained, e.g., by using a milling process.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
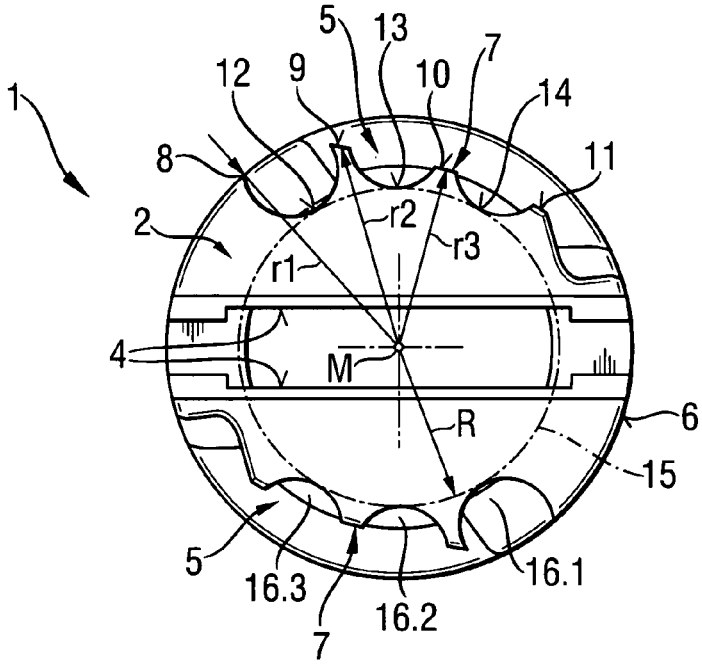
FIG. 1. a plan view of a cutting side of a drill head according to the present invention.
Figure 2:
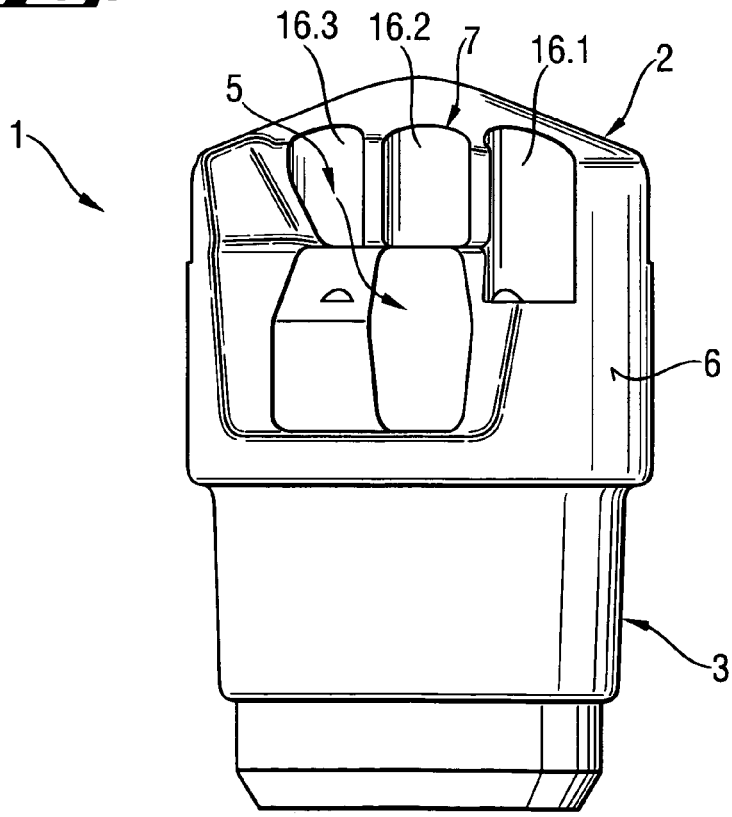
FIG. 2. a side view of the drill head according to the present invention.

A drill head 1 according to the present invention, which is shown in FIGS. 1–2, has a cutting side 2 and is provided at its end opposite, in the longitudinal direction of the drill head 1, the cutting side 2 with a shank section 3. Before a start of a drilling process, the drill head 1 is inserted with its shank section 3 in a tubular drill pipe. The cutting side 2 of the drill head 1 has a recess 4 for receiving an insertable cutting bit formed, e.g., of a hard material. At the cutting side 2, there are further provided two, diametrically opposite suction openings 5 which have, on an outer radial side 6 of the drill head 1, a toothing 7 forming a crushing profile.

The toothing 7 is uniformly formed and has a plurality of tooth crowns 8, 9, 10 and 11 and a plurality of tooth roots 12, 13 and 14. The radial distances r1, r2 and r3 of tooth crowns 8, 9 and 11 from a center M continuously decrease. The roots 12, 13 and 14 lie on a circle 15 having a radius R. Depressions 16.1, 16.2 and 16.3 have a shape of a circular segment.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A drill head comprising a bit; and at least one suction opening (5) for removing drilling and having a crushing profile, wherein the crushing profile is formed by a toothing (7) provided along a circumference of the drill head (1), and wherein the toothing (7) has a plurality of tooth crowns (8, 9, 10) having decreasing radial distances (r1, r2, r3) from a center (M) of the drill head (1).

2. A drill head according to claim 1, wherein the radial distances (r1, r2, r3) of respective tooth crown (8, 9, 10) decrease continuously.

3. A drill head according to claim 1, wherein depressions (16.1, 16.2, 16.3) between the tooth crowns (8,9, 10, 11) of the toothing (7) have a cross-section of a circular segment.

4. A drill head according to claim 1, wherein the toothing (7) has a plurality of roots (12, 13, 14) which lie substantially on a circle (15) having a center thereof in a center (M) of the drill head (1).

5. A drill head according to claim 1, wherein the drill head (1) is formed by a casting process.

* * * * *